US009812785B2

(12) United States Patent
Sonozaki et al.

(10) Patent No.: US 9,812,785 B2
(45) Date of Patent: Nov. 7, 2017

(54) WAVEGUIDE SLOT ANTENNA AND WARNING SYSTEM USING SAME

(71) Applicant: NTN CORPORATION, Osaka (JP)

(72) Inventors: Tomokazu Sonozaki, Mie (JP); Hiroyuki Noda, Mie (JP); Natsuhiko Mori, Mie (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 14/898,943

(22) PCT Filed: Jun. 16, 2014

(86) PCT No.: PCT/JP2014/065901
§ 371 (c)(1),
(2) Date: Dec. 16, 2015

(87) PCT Pub. No.: WO2014/203859
PCT Pub. Date: Dec. 24, 2014

(65) Prior Publication Data

US 2016/0372833 A1 Dec. 22, 2016

(30) Foreign Application Priority Data

Jun. 18, 2013 (JP) ..... 2013-127613
Mar. 3, 2014 (JP) ..... 2014-040325

(51) Int. Cl.
*H01Q 13/10* (2006.01)
*H01Q 13/22* (2006.01)
(Continued)

(52) U.S. Cl.
CPC ..... *H01Q 13/22* (2013.01); *H01Q 1/24* (2013.01); *H01Q 13/10* (2013.01); *H01Q 21/005* (2013.01)

(58) Field of Classification Search
USPC ..... 343/771, 702
See application file for complete search history.

(56) References Cited

U.S. PATENT DOCUMENTS 3,875,929 A 4/1975 Grant
4,940,990 A * 7/1990 Kharadly ..... H01Q 19/102 343/773
(Continued)

FOREIGN PATENT DOCUMENTS

JP 3-7406 1/1991
JP 2000-341030 12/2000
(Continued)

OTHER PUBLICATIONS

International Preliminary Report on Patentability and Written Opinion of the International Searching Authority issued Dec. 22, 2015 in International (PCT) Application No. PCT/JP2014/065901.
(Continued)

*Primary Examiner* — Jessica Han
*Assistant Examiner* — Hai Tran
(74) *Attorney, Agent, or Firm* — Wenderoth, Lind & Ponack, L.L.P.

(57) ABSTRACT

Provided is a waveguide tube slot antenna (A), including: a waveguide tube (10) having a transverse section having a rectangular shape in each part of a waveguide (2) in an extending direction thereof; and a plurality of radiating slots (3) arranged in the waveguide tube (10) at predetermined intervals, in which: the waveguide tube (10) includes a first waveguide tube forming member (11) and a second waveguide tube forming member (12) each having the transverse section having a shape with an end, the first waveguide tube forming member (11) and the second waveguide tube forming member (12) being configured to define the waveguide (2) by being coupled to each other; and the first waveguide tube forming member (11) is formed to have a flat shape and includes the plurality of radiating slots (3).

7 Claims, 5 Drawing Sheets

(51) Int. Cl.
*H01Q 21/00* (2006.01)
*H01Q 1/24* (2006.01)

(56) References Cited

U.S. PATENT DOCUMENTS 5,306,666 A * 4/1994 Izumi ..... H01L 21/76877
257/E21.17
2005/0146477 A1* 7/2005 Kelly ..... H01Q 1/3275
343/771

FOREIGN PATENT DOCUMENTS

JP 2007-228313 9/2007
JP 2008-205588 9/2008

OTHER PUBLICATIONS

International Search Report issued Aug. 12, 2014 in International (PCT) Application No. PCT/JP2014/065901.
Extended European Search Report issued Feb. 9, 2017 in corresponding European Application No. 14813361.4.
H. Asao et al., "Metal-Plated Plastic Waveguide Filter Using Injection Molding Process", 2003 IEEE MTT-S International Microwave Symposium Digest, vol. 2, Jun. 8-13, 2003, pp. 941-944.
Akiyoshi Mizutani et al., "Grating Lobe Suppression of Narrow-Wall Slotted Hollow Waveguide Millimeter-Wave Planar Antenna for Arbitrarily Linear Polarization", IEEE Transactions on Antennas and Propagation, vol. 55, No. 5, Feb. 1, 2007, pp. 313-320.

* cited by examiner

WAVEGUIDE SLOT ANTENNA AND WARNING SYSTEM USING SAME

TECHNICAL FIELD

The present invention relates to a waveguide tube slot antenna and an alarm system using the same.

BACKGROUND ART

A so-called waveguide tube slot antenna is sometimes used as an antenna for transmitting or receiving a radio wave. As an example of the waveguide tube slot antenna, there is known a waveguide tube slot antenna disclosed in Patent Literature 1. The waveguide tube slot antenna disclosed in Patent Literature 1 is formed by arranging a plurality of slot-like antenna elements (radiating slots) in a cross-sectionally rectangular metallic tube (waveguide tube) that is seamless in its transverse section (cross section orthogonal to a tube axis direction) at predetermined intervals.

The waveguide tube slot antenna may be used as an antenna for transmitting or receiving a radio wave having a high-frequency bandwidth (for example, radio wave having a millimeter wave band) and a radio wave having a low-frequency bandwidth (for example, radio wave having a centimeter wave band). The radio wave having a millimeter wave band is used, for example, for an on-vehicle radar system, and the radio wave having a centimeter wave band is used, for example, for a satellite broadcasting system using a broadcasting satellite (BS), a communication satellite (CS), or the like, a data transmission system such as a wireless LAN or Bluetooth (trademark), and an electronic toll collection system (ETC (trademark)). Note that, the radio wave having a millimeter wave band represents a radio wave having a wavelength of from 1 mm to 10 mm and a frequency of from 30 GHz to 300 GHz, and the radio wave having a centimeter wave band represents a radio wave having a wavelength of from 10 mm to 100 mm and a frequency of 3 GHz to 30 GHz.

CITATION LIST

Patent Literature 1: JP 2000-341030 A

SUMMARY OF INVENTION

Technical Problem

Incidentally, in recent years, use of a radio wave having a centimeter wave band for various alarm devices (alarm systems) configured to detect an abnormality and issue an alarm when the abnormality is detected is under investigation, and use of a waveguide tube slot antenna as an antenna part to be mounted to the alarm system is under investigation. Examples of the alarm system may include a biological reaction detection system configured to sense safety or an abnormal behavior of a target person by detecting his/her biological reaction, an intruder detection system configured to detect an intruder into a place with poor visibility such as a railway track, a security system configured to sense an intruder into different kinds of building, and a liquid amount management system configured to detect that a remaining amount of liquid stored inside a tank has fallen below a predetermined value.

As described above, application of the waveguide tube slot antenna for various purposes is under investigation.

However, as disclosed in Patent Literature 1, when the waveguide tube slot antenna is formed through use of a cross-sectionally rectangular metallic tube that is seamless in its transverse section, time and labor are required to process a portion that affects antenna performance, such as a radiating slot. Therefore, the waveguide tube slot antenna disclosed in Patent Literature 1 is low in mass-productivity and has a problem in cost.

In view of the above-mentioned circumstances, an object of the present invention is to allow a waveguide tube slot antenna having desired antenna performance to be manufactured at low cost and therefore to be applied for various purposes, in particular, to be applied to various alarm systems.

Solution to Problem

According to one embodiment of the present invention, which has been devised to attain the above-mentioned object, there is provided a waveguide tube slot antenna, comprising: a waveguide tube having a transverse section having a rectangular shape in each part of a waveguide in an extending direction of the waveguide; and a plurality of radiating slots arranged in the waveguide tube at predetermined intervals, wherein: the waveguide tube comprises a first waveguide tube forming member and a second waveguide tube forming member each having the transverse section having a shape with an end, the first waveguide tube forming member and the second waveguide tube forming member being configured to define the waveguide by being coupled to each other; and the first waveguide tube forming member is formed to have a flat shape and comprises the plurality of radiating slots.

As described above, when the first waveguide tube forming member that forms the waveguide tube (waveguide tube slot antenna) is set as a flat member comprising the radiating slot, at least the first waveguide tube forming member among the first waveguide tube forming member and the second waveguide tube forming member may be formed by a working method capable of forming the radiating slot simultaneously with the forming of the waveguide tube forming member, for example, by injection molding of a resin or a low-melting metal or by press working of a metal plate. This allows a high quality radiating slot to be formed easily at low cost, which may lead to low cost of not only the waveguide tube but also the waveguide tube slot antenna.

As an example of a specific mode of the waveguide tube, there may be given a waveguide tube comprising: a pair of wide walls having a relatively long transverse sectional dimension which are parallel with each other; and a pair of narrow walls having a relatively short transverse sectional dimension which are parallel with each other, wherein the first waveguide tube forming member further comprises any one of the pair of wide walls. It is to be understood that, alternatively, the first waveguide tube forming member may further comprise any one of the pair of narrow walls.

The first waveguide tube forming member and the second waveguide tube forming member may be both formed of a resin and may each comprise at least a conductive coating film formed on a defining surface of the waveguide. In this case, the radiating slot may be subjected to die molding simultaneously with the forming (injection molding) of the first waveguide tube forming member. This allows mass production of both the waveguide tube forming members having predetermined shapes with high precision and high efficiency. Further, both the waveguide tube forming members comprise the conductive coating film at least on the defining surface of the waveguide, and thus the radio wave (high-frequency current) supplied into the waveguide tube may smoothly propagate along the waveguide.

The film thickness of the conductive coating film becomes lower in resistance when being too thin, and when being too thick to the contrary, requires an excessive amount of time for coating film formation, which leads to increased cost. Accordingly, it is preferred that the film thickness of the conductive coating film beset to 0.2 μm or more and 1.5 μm or less. Further, the conductive coating film may have a single-layer structure, but it is preferred that a multi-layer structure be employed. Specifically, it is preferred that the conductive coating film be formed by stacking two or more kinds of metal plated coating films. For example, a first metal plated coating film is formed of copper or silver particularly high in conductivity among metals, and a second metal plated coating film is formed of nickel high in resistance on the first metal plated coating film. With this configuration, the conductive coating film excellent in both conductivity and resistance may be obtained, which improves reliability of the antenna.

The second waveguide tube forming member may comprise an inner wall configured to reduce a cross sectional area of the waveguide at a formation position of each of the plurality of radiating slots. This allows an increase in radiant efficiency of a radio wave supplied into the waveguide tube (waveguide) and radiated to an outside of the antenna through each radiating slot.

The waveguide tube slot antenna comprises a power supply port. Further, two inner walls adjacent to each other in a tube axis direction may satisfy a relational expression of $h_1 \leq h_2$, where $h_1$ represents a height dimension of one of the two inner walls on a side relatively close to the power supply port and $h_2$ represents a height dimension of another of the two inner walls on a side relatively far from the power supply port. With this configuration, an amount (radio wave intensity) of radio waves radiated to the outside of the antenna through each radiating slot hardly varies among the radiating slots, which allows a substantially equal amount of the radio waves to be radiated from each radiating slot. This may avoid variations of radiation performance of the radio wave in each part of the waveguide tube slot antenna in a longitudinal direction thereof as much as possible.

The first waveguide tube forming member that forms the waveguide tube slot antenna (waveguide tube) may further comprise a plurality of recess parts each having one of the plurality of radiating slots opened in an inner bottom surface thereof. This configuration may suppress extraneous emission referred to also as grating lobes, which allows a further increase in the antenna performance.

The waveguide tube slot antenna according to one embodiment of the present invention may be used, for example, for an alarm system in which an antenna part for transmitting or receiving a radio wave having a centimeter wave band is installed at a fixed point, as any one of or both an antenna part for transmission and an antenna part for reception in a preferred manner. Further, the waveguide tube slot antenna according to the one embodiment of the present invention may be manufactured at low cost, and therefore may contribute to the low cost, high gain, high efficiency, and widespread use of various alarm systems using the radio wave having a centimeter wave band.

Advantageous Effects of Invention

As described above, the one embodiment of the present invention allows a waveguide tube slot antenna having desired antenna performance to be manufactured at low cost.

DESCRIPTION OF EMBODIMENTS

Now, embodiments of the present invention are described with reference to the drawings.

Figure 1A:
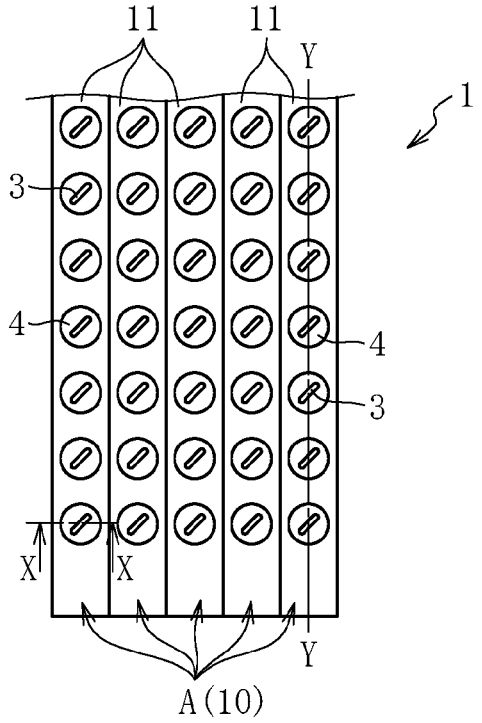
FIG. 1A is a schematic plan view of an antenna unit comprising waveguide tube slot antennas according to a first embodiment of the present invention.
Figure 1B:
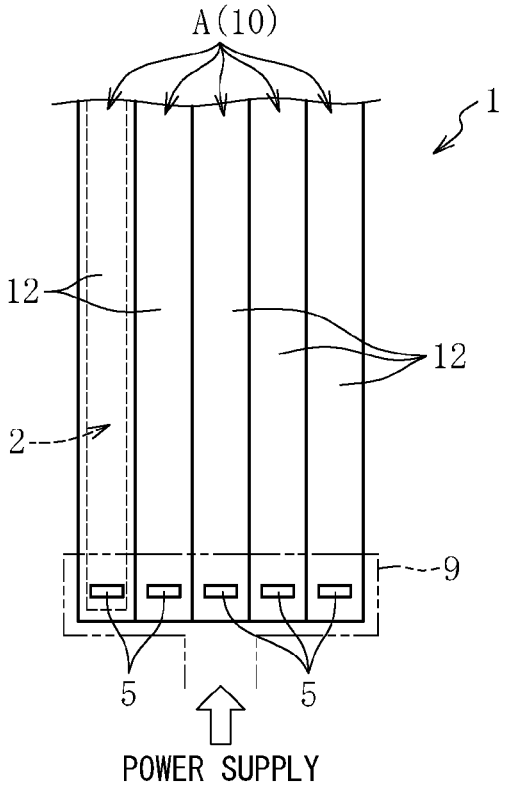
FIG. 1B is a back view of the antenna unit.

FIG. 1A and FIG. 1B are illustrations of a plan view and a back view of an antenna unit 1 comprising waveguide tube slot antennas A according to a first embodiment of the present invention, respectively. The antenna unit 1 illustrated in FIG. 1A and FIG. 1B is used to transmit or receive a radio wave having, for example, a centimeter wave band (for example, 24-GHz band), and comprises a plurality of (five in the example of FIG. 1A and FIG. 1B) waveguide tube slot antennas A connected in parallel with each other and a power supply waveguide tube 9 (see the chain double-dashed line in FIG. 1B) configured to supply high-frequency power to each of the waveguide tube slot antennas A. There are no special limitations on means for connecting the waveguide tube slot antennas A in parallel with each other, and, for example, fixation means such as adhesion, fixation with the double coated tape, or the depression and projection fitting is used singly or in combination of two or more kinds thereof. Of the five waveguide tube slot antennas A, for example, the antenna A located in a central part may function as an antenna for transmission (sending) of the radio wave, and the two antennas A arranged on each side of the antenna A in a width direction thereof may function as an antenna for reception of the radio wave.

Figure 2A:
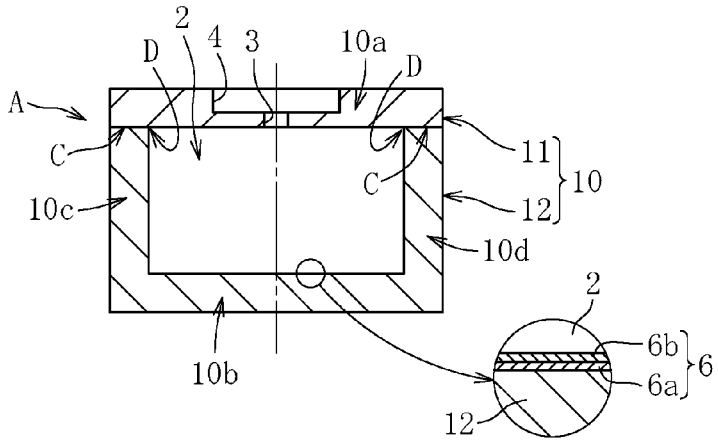
FIG. 2A is a schematic sectional view taken along the line X-X illustrated in FIG. 1A.
Figure 2B:
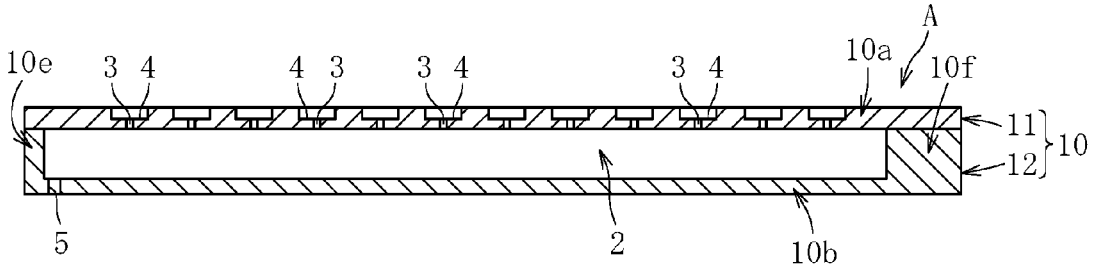
FIG. 2B is a schematic sectional view taken along the line Y-Y illustrated in FIG. 1A.

Next, a detailed structure of each waveguide tube slot antenna A is described also with reference to FIG. 2A and FIG. 2B.

The waveguide tube slot antenna A comprises, in a waveguide tube 10 comprising a waveguide 2 in an inside thereof, a plurality of radiating slots 3 at predetermined intervals along a tube axis direction of the waveguide tube 10 (extending direction of the waveguide 2). In the radiating slot 3 illustrated in FIG. 1A, a straight line extending through the central part in the width direction is inclined by 45° with respect to the tube axis direction (extending direction of the waveguide 2), but an inclination angle of the radiating slot 3 with respect to the tube axis direction may be set appropriately in accordance with a purpose or the like.

As illustrated in FIG. 2A, the waveguide tube 10 that forms the waveguide tube slot antenna A is a rectangular waveguide tube. The rectangular waveguide tube comprises a pair of wide walls 10*a* and 10*b* having a relatively long transverse sectional dimension which are parallel with each other and a pair of narrow walls 10*c* and 10*d* having a relatively short transverse sectional dimension which are parallel with each other, and has a transverse section having a rectangular shape (oblong shape) in each part of the waveguide 2 in the extending direction thereof. As illustrated in FIG. 2B, the waveguide tube 10 according to this embodiment further comprises a pair of termination walls 10*e* and 10*f* for closing one opening and the other opening in the tube axis direction. The radiating slot 3 is formed in one wide wall 10*a*.

The one wide wall 10*a* comprises a plurality of recess parts 4 opened in an outer surface of the one wide wall 10*a* along the tube axis direction, and one radiating slot 3 is opened in an inner bottom surface of each recess part 4. The recess part 4 according to this embodiment is formed so as to have a perfect circle shape in plan view, but the recess part 4 may be formed so as to have a rectangle shape, an ellipse shape, or the like in plan view. By forming such recess parts 4, it is possible to suppress extraneous emission referred to also as grating lobes. The other wide wall 10*b* comprises a power supply port (power supply slot) 5 in one end portion of the other wide wall 10*b* in the tube axis direction, and high-frequency power (radio wave) is supplied into the waveguide tube 10 (waveguide 2) through the power supply port 5.

The waveguide tube 10 is formed by coupling a first waveguide tube forming member 11 and a second waveguide tube forming member 12 to each other whose transverse sections, more specifically, transverse sections in each part of the waveguide 2 in the extending direction thereof, each have a shape with an end. Specifically, as illustrated in FIG. 2A, the waveguide tube 10 is formed by coupling the first waveguide tube forming member 11, which serves as the one wide wall 10*a* having the radiating slot 3 and has a flat shape as a whole, and the second waveguide tube forming member 12, which integrally comprises the other wide wall 10*b*, both the narrow walls 10*c* and 10*d*, and both the termination walls 10*e* and 10*f*, to each other. In short, in this embodiment, the waveguide tube 10 is formed by coupling the first waveguide tube forming member 11 having a flat shape and the second waveguide tube forming member 11 whose transverse sections each have a U shape in each part of the waveguide 2 in the extending direction thereof, to each other.

The first waveguide tube forming member 11 according to this embodiment is an injection-molded article of a resin, and the radiating slot 3 and the recess part 4 are formed by molding simultaneously with the injection molding. Further, the second waveguide tube forming member 12 is also an injection-molded article of a resin, and the power supply port 5 is formed by molding simultaneously with the injection molding. As a molding resin for the waveguide tube forming members 11 and 12, a resin having, for example, at least one kind of thermoplastic resin selected from the group consisting of a liquid crystal polymer (LCP), a poly(phenylene sulfide) (PPS), and a polyacetal (POM) as a base resin thereof is used. An appropriate filler is added to the base resin as necessary. In this embodiment, the resin material having the LCP as the main ingredient to which an appropriate amount of glass fibers (GF) is added as a filler is used to perform the injection molding for the first waveguide tube forming member 11 and the second waveguide tube forming member 12. The LCP is preferred because the LCP is excellent in form stability compared to a PPS or the like and may preferably suppress an occurrence amount of burrs caused by the molding. Further, the glass fiber is preferred because the glass fiber, which is cheaper than a carbon fiber (CF), may provide high form stability and mechanical strength to a molded article.

As illustrated in the enlarged view in FIG. 2A, inside the second waveguide tube forming member 12, a conductive coating film 6 is formed on at least a defining surface of the waveguide 2. In the same manner, inside the first waveguide tube forming member 11, the conductive coating film 6 is also formed on at least the defining surface of the waveguide 2. With this configuration, the radio wave (high-frequency current) may smoothly propagate along the waveguide 2 of the waveguide tube 10 (waveguide tube slot antenna A) formed by coupling the waveguide tube forming members 11 and 12 made of the resin. Note that, the conductive coating film 6 may be formed on entire surfaces of the waveguide tube forming members 11 and 12. With this configuration, masking formation work before the formation of the conductive coating film 6 and masking removal work after the formation of the conductive coating film 6 are unnecessary, which may suppress cost for coating film formation, and may further suppress manufacturing cost of the waveguide tube slot antenna A.

The conductive coating film 6 may be formed of a single-layer metal plated coating film, but in this embodiment, the conductive coating film 6 is formed of a first coating film 6*a* obtained by precipitation formation on the surfaces of the waveguide tube forming members 11 and 12 and a second coating film 6*b* obtained by precipitation formation on the first coating film 6*a*. The first coating film 6*a* may be a plated coating film of a metal that is particularly excellent in conductivity propagation property of the radio wave such as copper, silver, or gold. Further, the second coating film 6*b* may be a plated coating film of a metal that is excellent in resistance (corrosion resistance) such as nickel. With the conductive coating film 6 having such a stacked structure, the conductive coating film 6 may have high conductivity and high resistance simultaneously, and in addition, a usage amount of an expensive metal such as copper and silver may be suppressed to obtain the conductive coating film 6 at low cost.

As a method of forming the conductive coating film 6 (6*a* and 6*b*), for example, an electrolytic plating method or an electroless plating method may be employed, but the electroless plating method is preferred. This is because the electroless plating method is more likely to obtain the conductive coating film 6 (6*a* and 6*b*) having a uniform thickness than the electrolytic plating method, which is advantageous in ensuring desired antenna performance. The film thickness of the conductive coating film 6 becomes lower in resistance when being too thin, and when being too thick to the contrary, requires an excessive amount of time for coating film formation, which leads to increased cost. From such a viewpoint, the film thickness of the conductive coating film 6 is set to 0.2 μm or more and 1.5 μm or less. Note that, the film thickness of the first coating film 6*a* may be set to approximately from 0.1 μm to 1.0 μm, and the film thickness of the second coating film 6*b* may be set to approximately from 0.1 μm to 0.5 μm.

Note that, when there is no particular problem in terms of cost, the conductive coating film 6 may also be formed by stacking three or more kinds of metal plated coating films.

As described above, the waveguide tube slot antenna A according to this embodiment is completed, for example, by first forming the first waveguide tube forming member 11 and the second waveguide tube forming member 12 by the injection molding with the resin, forming the conductive coating film 6 on at least the defining surface of the waveguide 2 of both the waveguide tube forming members 11 and 12, and then coupling both the waveguide tube forming members 11 and 12 to each other. Thus, the waveguide tube slot antenna A comprising the radiating slot 3 and the recess part 4 formed in the one wide wall 10*a*, and the power supply port 5 formed in the other wide wall 10*b* is obtained. A coupling method for the first waveguide tube forming member 11 and the second waveguide tube forming member 12 is arbitrary. For example, depression and projection fitting (press-fitting) for fitting a projection part formed in any one of both the waveguide tube forming members 11 and 12 into a depression part formed in the other one, adhesion, or welding (method of fusing any one of or both the waveguide tube forming members 11 and 12 to couple both to each other) may be employed as the coupling method. Any one kind of the exemplified coupling methods may be employed, or two or more kinds thereof may be combined.

When both the waveguide tube forming members 11 and 12 are coupled to each other by adhesion, for example, a thermosetting adhesive, an ultraviolet-curable adhesive, or an anaerobic adhesive may be used as an adhesive therefor, but with the thermosetting adhesive that requires heat processing when the adhesive is cured, the waveguide tube forming members 11 and 12 made of a resin may be, for example, deformed while being subjected to the heat processing. Therefore, when both the waveguide tube forming members 11 and 12 are made of a resin as in this embodiment, the ultraviolet-curable adhesive or the anaerobic adhesive is preferred as the adhesive to couple both the members 11 and 12 to each other. Note that, the adhesive is generally an isolator, and hence when the adhesive adheres to a defining surface of the waveguide 2, there is a fear that a propagation property of the radio wave may be adversely affected. Therefore, when both the waveguide tube forming members 11 and 12 are integrally coupled to each other by the adhesion, it is important to pay attention so as to prevent the adhesive from adhering to the defining surface of the waveguide 2.

As described above, in the present invention, the first waveguide tube forming member 11 that forms the waveguide tube 10 (waveguide tube slot antenna A) is formed to have a flat shape having the radiating slot 3. In addition, both the waveguide tube forming members 11 and 12 are formed by injection molding of a resin. This allows the radiating slot 3 and the recess part 4 to be subjected to die molding simultaneously with the molding of the first waveguide tube forming member 11, and also allows the radiating slot 3 to be subjected to the die molding simultaneously with the molding of the second waveguide tube forming member 12. Accordingly, the manufacturing cost of the waveguide tube 10 may be reduced, and the low cost of the waveguide tube slot antenna A may be achieved.

Further, the antenna performance of the waveguide tube slot antenna may be appropriately changed by changing, for example, the formation mode of antenna components such as the radiating slots 3. Therefore, when the waveguide tube forming members 11 and 12 are formed by the injection molding of a resin, the waveguide tube slot antenna A corresponding to a requested characteristic may be subjected to mass production easily at low cost.

As described above, the cross-sectionally rectangular waveguide tube 10 that forms the waveguide tube slot antenna A is formed by coupling the two waveguide tube forming members 11 and 12, one of which has a flat shape, to each other. Accordingly, in inner corner portions D of the waveguide tube 10, coupling parts C of both the waveguide tube forming members 11 and 12 (one end of each of the coupling parts C) appear. The waveguide tube slot antenna A formed of such the waveguide tube 10 may be used as an antenna for transmitting or receiving a radio wave particularly having a low-frequency bandwidth (for example, radio wave having a centimeter wave band) in a preferred manner. This is because the radio wave flowing inside the waveguide 2 may overflow from the coupling part C described above onto the outside when the waveguide tube slot antenna A having the above-mentioned structure is used as an antenna for transmitting or receiving a radio wave having a high-frequency bandwidth (for example, radio wave having a millimeter wave band), while it suffices even without the need to consider such a concern as described above when the waveguide tube slot antenna A is used as an antenna for transmitting or receiving a radio wave having a low-frequency bandwidth.

Therefore, the waveguide tube slot antenna A (antenna unit 1) described above may be used, for example, as the antenna part of an alarm system which comprises an antenna part for transmitting or receiving the radio wave having a centimeter wave band and in which the antenna part is installed at a fixed point, in a preferred manner. Examples of the alarm system of this kind may include a biological reaction detection system configured to sense safety or an abnormal behavior of a target person by detecting his/her biological reaction, an intruder (intruding object) detection system configured to detect an intruder (intruding object) into a place with poor visibility such as a railway track, a security system configured to sense an intruder into different kinds of building, and a liquid amount management system configured to detect that a remaining amount of liquid stored inside a tank has fallen below a predetermined value. Further, the waveguide tube slot antenna A according to one embodiment of the present invention may be manufactured at low cost, and therefore may contribute to the low cost, high gain, high efficiency, and widespread use of various alarm systems exemplified above.

The waveguide tube slot antenna A according to the first embodiment of the present invention is described above, but appropriate changes may be made to the waveguide tube slot antenna A within a scope that does not depart from the gist of the present invention. Now, other embodiments of the present invention are described with reference to the drawings, but the components equivalent to those of the first embodiment described above are denoted by common reference symbols, and duplicate descriptions thereof are omitted as much as possible.

Figure 3A:
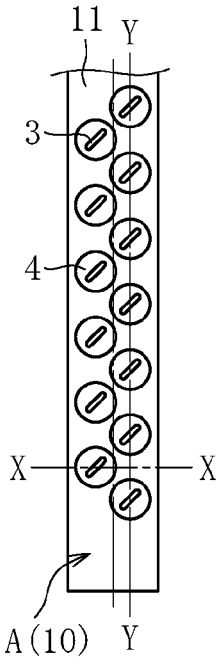
FIG. 3A is a schematic plan view of a waveguide tube slot antenna according to a second embodiment of the present invention.
Figure 3B:
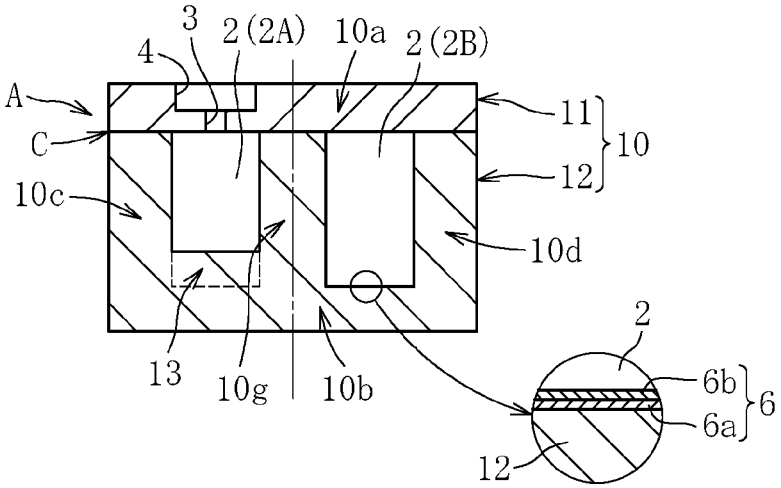
FIG. 3B is a schematic sectional view taken along the line X-X illustrated in FIG. 3A.
Figure 3C:
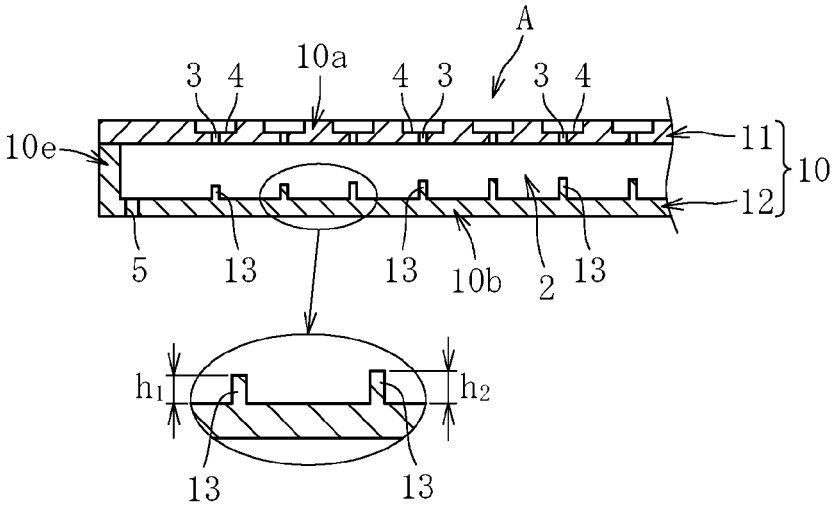
FIG. 3C is a schematic sectional view taken along the line Y-Y illustrated in FIG. 3A.

FIG. 3A to FIG. 3C are schematic illustrations of a partial plan view, a transverse sectional view, and a longitudinal sectional view of a waveguide tube slot antenna A according to a second embodiment of the present invention, respectively. In the waveguide tube slot antenna A according to this embodiment, as illustrated in FIG. 3A, two radiating slot rows each obtained by arranging the plurality of radiating slots 3 along the tube axis direction at predetermined intervals are provided in the width direction of the waveguide tube 10, and at the same time, the radiating slot 3 forming one of the radiating slot rows and the radiating slot 3 forming the other radiating slot row are located at mutually different positions in the tube axis direction. To briefly describe, in the waveguide tube slot antenna A according to this embodiment, the plurality of radiating slots 3 and recess parts 4 are arranged in a staggered shape.

The waveguide tube slot antenna A (waveguide tube 10) according to this embodiment further comprises: a branching wall 10*g* arranged in parallel with the narrow walls 10*c* and 10*d* and configured to branch the waveguide 2 into two waveguides 2A and 2B; and a plurality of inner walls 13 configured to reduce a cross sectional area of the waveguides 2 (2A and 2B) at formation positions of the radiating slots 3. The inner wall 13 is erected on an inner surface of the wide wall 10*b*, and is formed so that two inner walls 13 and 13 adjacent to each other in the tube axis direction satisfy a relational expression of $h_1 \leq h_2$, where $h_1$ represents a height dimension of the inner wall 13 on a side relatively close to the power supply port 5 and $h_2$ represents a height dimension of the inner wall 13 on a side relatively far from the power supply port 5 (see the enlarged view in FIG. 3C). One radiating slot row is formed along the waveguide 2A, and the other radiating slot row is formed along the waveguide 2B.

The waveguide tube 10 that forms the waveguide tube slot antenna A according to this embodiment is also formed by coupling the first waveguide tube forming member 11 and the second waveguide tube forming member 12 made of the resin to each other whose transverse sections each have a shape with an end in each part of the waveguide 2 in the extending direction thereof and in which the conductive coating film 6 is formed on at least the defining surface of the waveguide 2. Specifically, the waveguide tube 10 is formed by coupling the first waveguide tube forming member 11, which comprises one wide wall 10*a* having the radiating slot 3 and the recess part 4 and is formed to have a flat shape as a whole, and the second waveguide tube forming member 12, which integrally comprises the other wide wall 10*b* having the power supply port 5 and a plurality of inner walls 13, both the narrow walls 10*c* and 10*d*, both the termination walls 10*e* and 10*f*, and the branching wall 10*g*, to each other.

In this manner, the waveguide tube slot antenna A according to the second embodiment of the present invention comprises the inner wall 13 configured to reduce the cross sectional area of the waveguide 2 at the formation position of the radiating slot 3. This may enhance radiant efficiency of the radio wave that propagates inside the waveguide 2. In particular, as in this embodiment, when the two inner walls 13 and 13 adjacent to each other in the tube axis direction are set to satisfy the relational expression of $h_1 \leq h_2$, where $h_1$ represents the height dimension of the inner wall 13 on the side relatively close to the power supply port 5 and $h_2$ represents the height dimension of the inner wall 13 on the side relatively far from the power supply port 5, the amount of radio waves radiated to the outside of the antenna A through each radiating slot 3 hardly varies among the radiating slots 3, which allows a substantially equal amount of the radio waves to be radiated from each radiating slot 3. This may avoid variations of antenna performance in each part of the waveguide tube slot antenna A in the tube axis direction as much as possible, which increases reliability of the waveguide tube slot antenna A.

The waveguide tube slot antenna A according to this embodiment additionally comprises the inner walls 13 described above, and hence it is conceivable that a structure thereof becomes complicated and that manufacturing cost thereof increases. However, the second waveguide tube forming member 12 comprising the inner wall 13 is made of a resin, and hence the inner wall 13 may be subjected to the die molding simultaneously with the injection molding of the second waveguide tube forming member 12. This allows components of the waveguide tube slot antenna A to be obtained easily with high accuracy, and also allows the manufacturing cost to be suppressed.

Although not shown, three or more radiating slot rows may be provided. In this case, two or more branching walls 10*g* may be arranged to branch the waveguide 2 into three or more waveguides.

Figure 4:
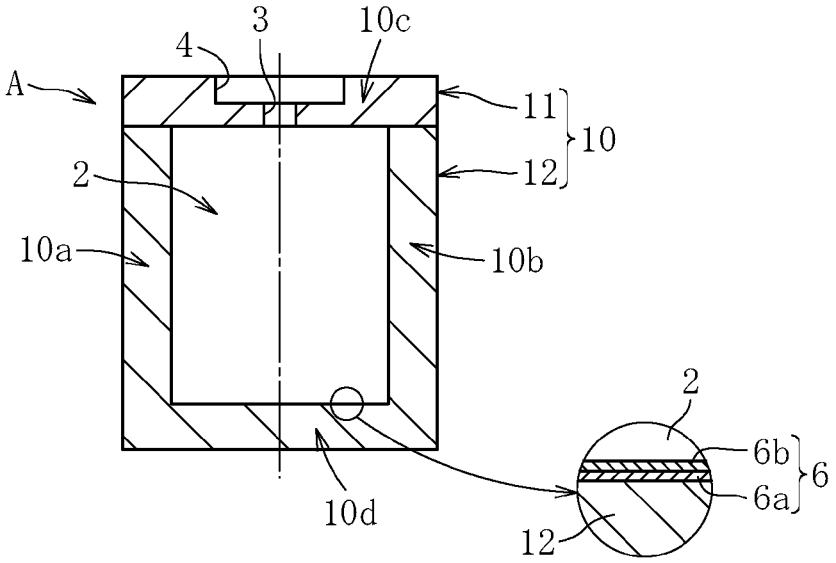
FIG. 4 is a schematic transverse sectional view of a waveguide tube slot antenna according to a third embodiment of the present invention.

FIG. 4 is a schematic transverse sectional view of the waveguide tube slot antenna A according to a third embodiment of the present invention. The waveguide tube slot antenna A according to this embodiment is different from the waveguide tube slot antenna A according to the first embodiment mainly in that the radiating slot 3 and the recess part 4 are formed in one narrow wall 10*c* and that the power supply port 5 is formed in the other narrow wall 10*d* (the power supply port 5 is not shown in FIG. 4). With such a modification, the first waveguide tube forming member 11 is formed to have a flat shape having one narrow wall 10*c*. Note that, although not shown, also in this embodiment, the inner wall 13 and the branching wall 10*g* employed in the second embodiment may be provided.

As described above, both the waveguide tube forming members 11 and 12 are integrally coupled to each other by means such as the depression and projection fitting (press-fitting), the adhesion, or the welding, to thereby form the waveguide tube 10 (waveguide tube slot antenna A), but both the waveguide tube forming members 11 and 12 may be integrally coupled to each other by using a fastening member such as a screw and a bolt, to thereby form the waveguide tube 10 (waveguide tube slot antenna A).

In addition, in the above-mentioned embodiments, both the first waveguide tube forming member 11 and the second waveguide tube forming member 12 are the injection-molded article of the resin, but any one of or both the waveguide tube forming members 11 and 12 may be a press-molded article of a metal, or an injection-molded article of a low-melting metal (for example, magnesium or aluminum). In this case, the conductive coating film 6 becomes unnecessary for components that are molded articles of a metal (processing of forming the conductive coating film 6 may be omitted).

Figure 5:
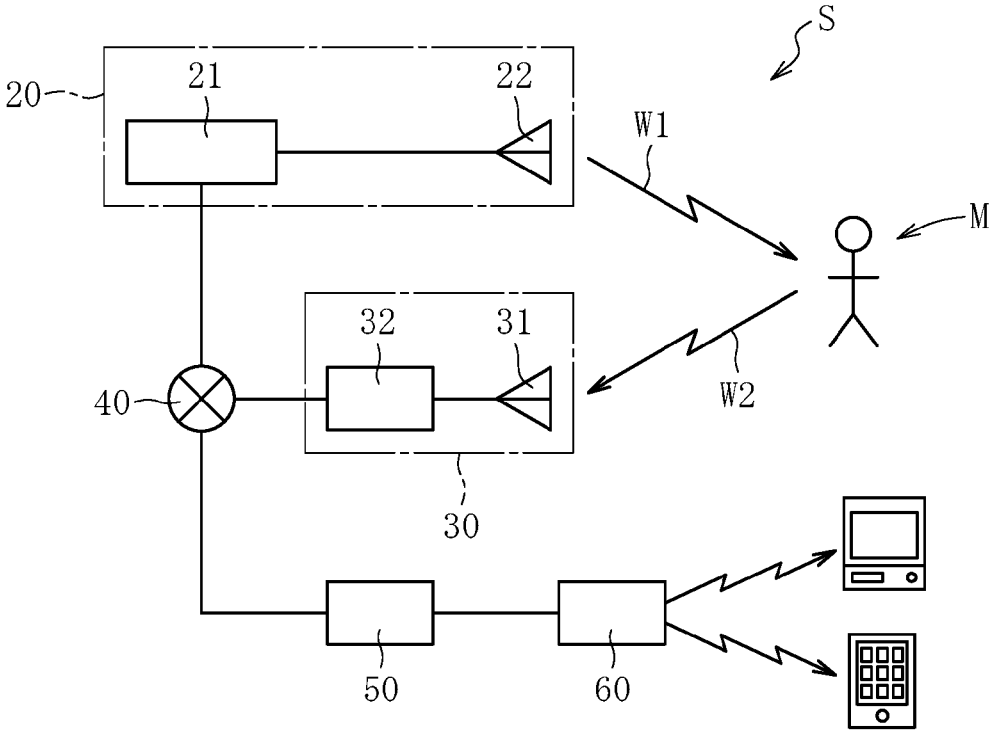
FIG. 5 is a diagram for schematically illustrating a system configuration example of an alarm system to which the waveguide tube slot antenna according to one embodiment of the present invention is applicable.

In this case, a system configuration example of an alarm system to which the waveguide tube slot antenna A according to one embodiment of the present invention is applicable as any one of or both an antenna part for transmission and an antenna part for reception is schematically illustrated in FIG. 5. To briefly describe the system configuration example, an alarm system S illustrated in FIG. 5 is configured to acquire various kinds of information (in this case, data on a location, a heart rate, and a respiration rate) on a person M to be detected from among reflected waves and the like received by an antenna part for reception, and transmit, when it is determined that an abnormality exists in the acquired various kinds of information, abnormality information (alarm) thereon to an information terminal. Such an alarm system may be used as, for example, a condition monitoring system for monitoring conditions of an inpatient, a newborn, or a solitary aged person. When such a monitoring system is introduced, the conditions of the inpatient or the like may be constantly grasped even when the inpatient or the like cannot be attended constantly. This allows alleviation of workload on a doctor or a nurse, and allows alleviation of physical and mental burdens on a family.

The alarm system S illustrated in FIG. 5 comprises: a radio wave transmission device 20 comprising an antenna 22 for transmission configured to send (transmit) a transmission wave W1 generated by a transmission wave generation unit 21 to the person M to be detected; a reception device 30 comprising an antenna 31 for reception configured to receive a reflected wave W2; a mixer 40; a determination device 50 configured to extract a predetermined frequency component from within a mixed wave generated by the mixer 40 to acquire the above-mentioned various kinds of information (data) on the person M to be detected, and determine whether or not the acquired data falls within a predetermined range (whether or not an abnormal item exists in the various kinds of information); and an alarm transmission device 60 configured to transmit, when the determination device 50 has determined that an abnormal item exists, the abnormality information (alarm) thereon to the information terminal (for example, personal mobile terminal or PC installed in a monitoring center). A line used to transmit the alarm from the alarm transmission device 60 to the information terminal may be any one of a wireless line and a wired line.

Figure 6:
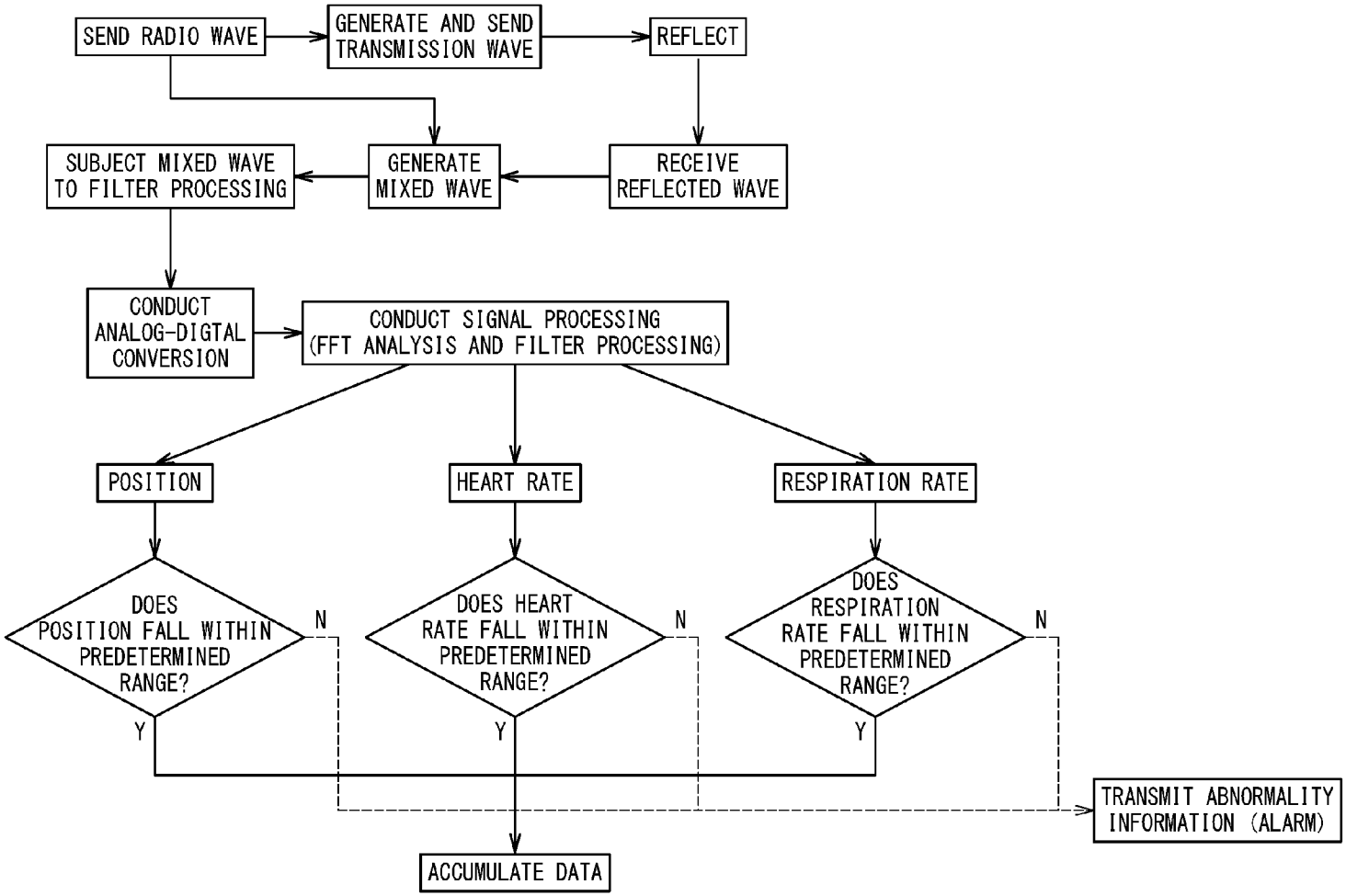
FIG. 6 is a flowchart for illustrating a flow followed by the alarm system illustrated in FIG. 5 until transmission of an alarm.

The alarm system S illustrated in FIG. 5 is obtained by applying a frequency modulation continuous wave (FMCW) radar for conducting distance measurement or the like by using a continuous wave subjected to frequency modulation, and specifically, transmits the abnormality information (alarm) to the information terminal in accordance with such steps as illustrated in FIG. 6. Note that, the FMCW radar uses the continuous wave as a transmission wave, which produces such an advantage that a desired signal is easy to obtain even with a lowered transmission output. Further, the lowered transmission output allows at least the radio wave transmission device 20 to be downsized and made light weighted, which produces such an advantage that the alarm system S may be downsized and made light weighted as a whole.

With reference to FIG. 6, a flow followed by the alarm system S until transmission of the alarm is described. First, in the transmission wave generation unit 21 included in the radio wave transmission device 20, a radio wave emitted from a voltage control oscillator (VCO) serving as a radio wave generation unit (not shown) is, for example, modulated (subjected to FM modulation) and amplified by modulation and amplification means (not shown) to generate the transmission wave W1, and the transmission wave W1 is sent from the antenna 22 for transmission to the person M to be detected. The reflected wave W2 that has been reflected after hitting on the person M to be detected is received by the antenna 31 for reception included in the reception device 30. The reflected wave W2 received by the antenna 31 for reception is amplified and demodulated by amplification and demodulation means (not shown) provided inside the reception device 30, and is then sent into the mixer 40. The mixer 40 mixes a part of the radio wave emitted from the voltage control oscillator with the reflected wave W2 received by the antenna 31 for reception (strictly, received wave obtained by, for example, amplifying the reflected wave W2), to generate a mixed wave.

The mixed wave is introduced into the determination device 50, and is first subjected to filtering processing. With this processing, a predetermined frequency component is extracted from within the mixed wave. The extracted frequency component is converted into a digital signal (waveform data) by an analog-digital conversion circuit (not shown), and is then introduced into a signal processing unit (not shown). The waveform data introduced into the signal processing unit is subjected to FFT analysis, to thereby be decomposed into a plurality of pieces of frequency data. After the individual pieces of frequency data are subjected to the filtering processing, pieces of data on the location, the heart rate, and the respiration rate of the person M to be detected are obtained. A determination unit (not shown) included in the determination device 50 determines whether or not each of the pieces of data on the location, the heart rate, and the respiration rate of the person M to be detected falls within a predetermined range (within a range of the threshold value) in comparison with a threshold value stored in advance. When at least one of the location, the heart rate, and the respiration rate of the person M to be detected is determined to have an abnormality, the alarm transmission device 60 transmits the abnormality information (alarm) to the personal mobile terminal, the PC installed in the monitoring center, or the like. The piece of data on an item determined to have "no abnormality" by the above-mentioned determination processing is, for example, stored and accumulated in a storage unit included in the determination device 50.

Note that, the system configuration of the alarm system S described above is merely an example, and may be appropriately changed depending on a purpose or the like.

REFERENCE SIGNS LIST

1 antenna unit
2 waveguide
3 radiating slot
4 recess part
5 power supply port
6 conductive coating film
6*a* first coating film
6*b* second coating film
10 waveguide tube
10*a* wide wall
10*b* wide wall
10*c* narrow wall
10*d* narrow wall
10*g* branching wall
11 first waveguide tube forming member
12 second waveguide tube forming member
13 inner wall
A waveguide tube slot antenna
C coupling part
S alarm system

The invention claimed is:

1. A waveguide tube slot antenna comprising:

a waveguide tube having a transverse section having a rectangular shape in each part of a waveguide in an extending direction of the waveguide; and a plurality of radiating slots arranged in the waveguide tube at predetermined intervals, wherein:

the waveguide tube comprises a first waveguide tube forming member and a second waveguide tube forming member each having the transverse section having a shape with an end, the first waveguide tube forming member and the second waveguide tube forming member being configured to define the waveguide by being coupled to each other;

the first waveguide tube forming member is formed to have a flat shape and comprises the plurality of radiating slots;

the first waveguide tube forming member and the second waveguide tube forming member are both formed of a resin and each comprise at least a conductive coating film formed on a defining surface of the waveguide; and the conductive coating film is formed by stacking two or more kinds of metal plated coating films.

2. The waveguide tube slot antenna according to claim 1, wherein:

the waveguide tube comprises:

a pair of wide walls having a relatively long transverse sectional dimension which are parallel with each other; and a pair of narrow walls having a relatively short transverse sectional dimension which are parallel with each other; and the first waveguide tube forming member further comprises any one of the pair of wide walls.

3. The waveguide tube slot antenna according to claim 1, wherein the conductive coating film is set to have a film thickness of 0.2 μm to 1.5 μm.

4. The waveguide tube slot antenna according to claim 1, wherein the second waveguide tube forming member comprises an inner wall configured to reduce a cross sectional area of the waveguide at a formation position of each of the plurality of radiating slots.

5. The waveguide tube slot antenna according to claim 4, further comprising a power supply port, wherein two inner walls adjacent to each other in a tube axis direction satisfy a relational expression of $h_1 \leq h_2$, where $h_1$ represents a height dimension of one of the two inner walls on a side relatively close to the power supply port and $h_2$ represents a height dimension of another of the two inner walls on a side relatively far from the power supply port.

6. The waveguide tube slot antenna according to claim 1, wherein the first waveguide tube forming member further comprises a plurality of recess parts each having one of the plurality of radiating slots opened in an inner bottom surface thereof.

7. An alarm system comprising:

the waveguide tube slot antenna of claim 1; and an antenna part including a first antenna configured to transmit a radio wave and a second antenna configured to receive a radio wave, wherein:

the antenna part is installed at a fixed point; and the waveguide tube slot antenna of claim 1 is applied to any one of or both of the first and second antennas.

* * * * *